United States Patent [19]

Weideman

[11] 4,277,862

[45] Jul. 14, 1981

[54] TOOTHBRUSH

[75] Inventor: Christiaan R. Weideman, Johannesburg, South Africa

[73] Assignee: Alexander E. Vowles, Marister, South Africa

[21] Appl. No.: 98,054

[22] Filed: Nov. 28, 1979

[30] Foreign Application Priority Data

Jan. 25, 1979 [ZA] South Africa ..... 79/0329

[51] Int. Cl.[3] ..... A46B 9/04

[52] U.S. Cl. ..... 15/110; 128/62 A

[58] Field of Search ..... 15/110, 167 R; 128/62 A

[56] References Cited

U.S. PATENT DOCUMENTS

| | | | |
|---|---|---|---|
| 2,088,839 | 8/1937 | Coney et al. | 15/110X |
| 2,117,174 | 5/1938 | Jones | 15/110 |
| 2,129,082 | 9/1938 | Byrer | 128/62 A |

FOREIGN PATENT DOCUMENTS

| | | | |
|---|---|---|---|
| 642910 | 5/1928 | France | 128/62 A |

*Primary Examiner*—Peter Feldman

[57] ABSTRACT

This invention relates to a toothbrush which includes tufts of bristles which are fixed to and project from a head to define a substantially rectangular brush surface and a pair of resilient gum massage members which are located on opposite long sides of the brush surface with each massage member being at least as long as the brush surface occupied by three tufts of bristles but shorter than the surface and as wide as a tuft of bristles.

2 Claims, 2 Drawing Figures

TOOTHBRUSH

FIELD OF THE INVENTION

This invention relates to toothbrushes.

BACKGROUND OF THE INVENTION

It is well known that a substantial proportion of dental disorders and particularly tooth loss are directly attributable to periodontal deterioration and disease. Periodontal problems can be reduced by physical massage of the periodontal tissue or gums surrounding teeth. The bristles of a conventional toothbrush provide the cleansing action of the brush by abrasion and picking and although they do come into contact with the user's gums the massage action they provide is minimal.

Brushes intended for gum massage are known. These brushes include rubber or like formations which are arranged amongst the conventional brush bristles for massaging the user's gums while the conventional bristles provide the normal abrasive cleaning and picking action. In one form of known brush the formations extend along the length of the bristle zone on either side of the brush head and in a second form are columns or cones made of rubber which are spaced among the bristles. A problem with brushes of the first type is that the formations prevent or at least seriously inhibit the conventional and necessary action of the brush bristles in cleaning the interstices between the teeth when the brush head is moved transversely over the length of the user's teeth. Additionally, these brushes are unacceptable from a hygienic point of view in that the spaces between the formations and the adjacent bristles on the brush head provide excellent traps, which are difficult to clean, for used toothpaste and particles dislodged from the user's teeth. A disadvantage to brushes of the second type is that the formations are of necessity made from soft resilient material to avoid point contact damage to the user's gums and because of the flexibility over their lengths and their small gum contact areas provide insufficient traction on the gums, particularly in the longitudinal direction of the brush head, to be effective in providing the required massage action without damage to the user's gums.

OBJECT OF THE INVENTION

It is the object of this invention to provide a toothbrush which will minimise the problems mentioned above and which is capable of massaging a user's gums to a greater extent than is possible with known toothbrushes.

SUMMARY OF THE INVENTION

A toothbrush according to the invention includes a head, tufts of bristles which are fixed to and project from the head to define at their free ends an elongated brush surface and a massage member which is exposed at or near to one of the longitudinal sides of the brush surface and has a resilient integral massage surface at or near the brush surface and a length at least as long as the brush surface occupied by three tufts of brush bristles but is shorter than the length of the brush surface so that movement of at least some of the brush bristles is not impeded by the member in a direction transverse to the long axis of the brush head. Preferably, however, the brush includes two massage members which are located on opposite sides of the brush surface.

In one form of the invention the massage surface of the or each massage member could include upstanding massage formations.

In another form of the invention the massage members may be joined at their bases by a bridge member with the tufts of bristles between the massage members passing through the bridge member.

In this specification, when reference is made to tufts of brush bristles the tufts are understood to be those on a conventional toothbrush which are forty or so in number and have a tuft diameter at the brush surface of about one and a half millimeters with a spacing between tufts on the brush head of about the same dimension. Should the massage member be used on a brush with a bristle configuration which differs from that above the length of the massage member, to be effective, should be no shorter than 25% of the length of the brush head and about two millimeters wide of the massage surface of the member.

BRIEF DESCRIPTION OF THE DRAWINGS

The invention is now described by way of example with reference to the drawings in which.

DETAILED DESCRIPTION

Figure 1:
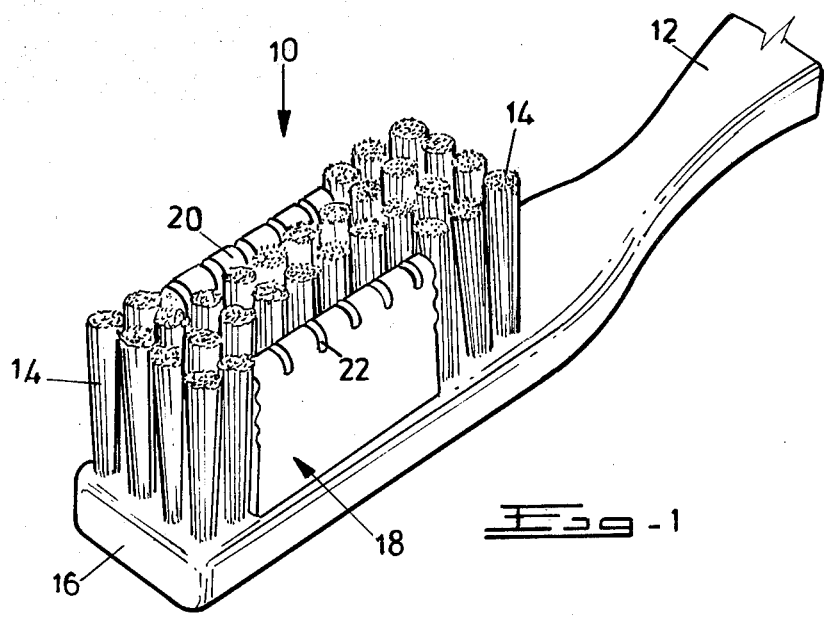
FIG. 1 is a perspective view from above of the head of the toothbrush of the invention.

The brush of the invention is shown in FIG. 1 of the drawing to include a head indicated generally at 10 and a fragment of a handle 12.

The head 10 includes conventional bristle tufts 14 which are anchored in the head base 16 with their free ends defining a substantially rectangular brush surface.

The head, in this embodiment, carries two slab like massage members 18 which are made from a non-toxic resilient material such as rubber latex or any other suitable plastics material. The members 18 are bonded to the head base 16 by a suitable adhesive.

The massage ends 20 of the members 18 are located, as seen in the drawing, slightly below the brush surface so that the bristles may be polished during manufacture and include transverse grooves 22 which between them define upstanding massage formations. The massage formations could, in another embodiment, be made in the form of upstanding studs or teeth which project from the body of the members 18.

The sides of the massage members 18 towards the massage end could be rippled as shown in the drawing, or holed or grooved to make the upper ends of the members more resiliently deformable under brushing pressure than they are at or towards their base portions which are attached to the head base 16.

Figure 2:
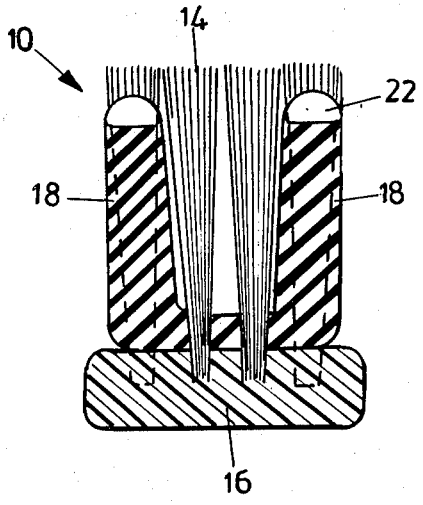
FIG. 2 is a sectional end elevation of the head of a second embodiment of the toothbrush of the invention with the section being taken through the massage member of the brush.

Like reference numerals in FIG. 2 of the drawings denote like components. In this embodiment of the invention the massage members 18 are joined at their bases so that the members are components of a single channel-shaped element the base of which may be bonded to the head base 16, with the bristle tufts between the members 18 passing through the base of the element to anchor the element in position on the head. Assembly of the brush is simplified by this method of construction.

As is seen in the drawing the members 18 taper outwardly towards the base of the channel to increase the rigidity of the members at and towards their bases. The sides of the members could additionally include the ripples or grooves which were described with reference to the FIG. 1 embodiment to increase the progressively rigidifying effect.

To ensure an adequate degree of traction between the massage ends 20 of the members 18 and the user's gums it is important that the effective width of the massage ends of the members 18 be substantially as wide as the diameter of the area occupied in a brush surface by a tuft of bristles and as long as at least three tufts of bristles at the brush surface. It is, however, equally important that a number of tufts of bristles on the long sides of the brush surface are unshielded by the members 18 so that the transverse cleaning and picking action of the brush is not lost to the user.

In use, the brush of the invention is used in the conventional manner with the massage members 18, when brought into contact with the user's gums, providing a massage effect.

The invention is not limited to the precise constructional details as herein described and the brush could, for example, include one or more resilient massage and abrasion members which are located among the bristles of the brush. Additionally, the massage ends 20 of the members 18 may be located on the outside of the bristles of the head and be located at or above the brush surface of the bristles. Also, the massage members could be embedded in the material of the head and fastened in place by any suitable means.

I claim:

1. A toothbrush which comprises a head, a plurality of tufts of bristles which are fixed to and project from the head, the bristles defining at their free ends an elongate brush surface, and two massage members which extend upwardly from the head and which are located on the opposing longer sides of the brush surface, each massage member having a resilient integral massage surface at or near the brush surface, being adjacent at least three tufts of bristles, and being in line with bristles at each of its ends so that the bristles provide unimpeded brushing action transversely to the massage member.

2. A brush as claimed in claim 1 in which the massage surface of the massage member is below the main brush surface of the bristles.

* * * * *